US008062195B2

(12) United States Patent
Israeli

(10) Patent No.: US 8,062,195 B2
(45) Date of Patent: Nov. 22, 2011

(54) INDIVIDUAL PHYSICAL TRAINING DEVICE

(76) Inventor: Amit Israeli, Kfar Vitkin (IL)

( * ) Notice: Subject to any disclaimer, the term of this patent is extended or adjusted under 35 U.S.C. 154(b) by 0 days.

(21) Appl. No.: 12/444,691

(22) PCT Filed: Oct. 10, 2007

(86) PCT No.: PCT/IL2007/001224

§ 371 (c)(1),
(2), (4) Date: Nov. 30, 2009

(87) PCT Pub. No.: WO2008/044238

PCT Pub. Date: Apr. 17, 2008

(65) Prior Publication Data

US 2010/0105532 A1 Apr. 29, 2010

Related U.S. Application Data

(60) Provisional application No. 60/850,292, filed on Oct. 10, 2006.

(51) Int. Cl.
*A63B 21/00* (2006.01)

(52) U.S. Cl. ..... 482/131

(58) Field of Classification Search ..... 482/23, 482/140, 142–143, 139, 148, 132, 33–34, 482/37–38, 41, 51
See application file for complete search history.

(56) References Cited

U.S. PATENT DOCUMENTS

| | | | | |
|---|---|---|---|---|
| 3,857,561 | A * | 12/1974 | Cecchettini et al. | 482/142 |
| 4,506,884 | A * | 3/1985 | Hankin | 482/131 |
| 5,242,342 | A * | 9/1993 | Silverman | 482/54 |
| 5,306,220 | A * | 4/1994 | Kearney | 482/94 |
| 5,711,749 | A * | 1/1998 | Miller | 482/135 |
| 6,436,050 | B2 * | 8/2002 | Garrison et al. | 600/459 |
| 6,692,418 | B2 * | 2/2004 | Shahan | 482/144 |
| 6,767,314 | B2 | 7/2004 | Thompson | |
| 2004/0097333 | A1 | 5/2004 | Nappari | |
| 2009/0054215 | A1 * | 2/2009 | McBride et al. | 482/129 |

FOREIGN PATENT DOCUMENTS

| | | | |
|---|---|---|---|
| DE | 34 20 858 | A1 | 12/1985 |
| DE | 3420858 | A1 * | 12/1985 |

* cited by examiner

*Primary Examiner* — Lori Baker
(74) *Attorney, Agent, or Firm* — Oliff & Berridge, PLC

(57) ABSTRACT

The present invention provides a personal training device and system for applying controlled load on body muscles. The training device generally comprises a ground supported frame that holds a torso support assembly and a foot support assembly. The torso support assembly further comprises a torso support that is vertically displaceable with respect to the frame along a first axis and fixable at various positions along said first axis. The foot support assembly includes a foot-engaging member that is horizontally displaceable with respect to the frame along a second axis normal to the first axis and fixable at various positions along the second axis.

15 Claims, 8 Drawing Sheets

INDIVIDUAL PHYSICAL TRAINING DEVICE

FIELD OF THE INVENTION

The invention relates generally to an individual physical training device and system for applying controlled load on body muscles while training.

BACKGROUND OF THE INVENTION

A typical feature of a personal training program is the need to apply different loads on trained muscle groups depending on a person's inherent characteristics (age, weight, etc.) and his fitness status. The most basic way of physical training is to use the individual's own body as the training loads without the use of any instruments, e.g. performing pull-ups, push-ups, etc. An exercise apparatus enabling a user to exert muscle effort against user's own body weight resistance is described for example in U.S. Pat. No. 6,767,314 to Thompson. When using such apparatus, user may selectively incline the carriage assembly in a carriage assembly-receiving track in an operational state for exerting muscular effort against varying degrees of the user's own body weight resistance to achieve some level of physical activity or as part of an otherwise regular exercise regimen.

Modern fitness training usually employs various training devices for the purpose of systemizing personal training. In such devices, the training is against an adjustable load. The exercises in such devices are fixed through and the load adjustment is through variable weight loads, which may be added or removed. Generally, such devices are relatively expensive and not normally suited for home installation. Furthermore, typically different devices are needed for training different muscle groups. This typically increases the cost for a proper fitness installation and also increases the demand for space therefore. Furthermore, there is a need to provide fitness training device for individuals with physical limitations, such as overweight individuals, individuals lacking physical fitness and people having physical or other handicaps.

GENERAL DESCRIPTION OF THE INVENTION

It is an object of the invention to provide a personal training device of a relatively simple construction, relatively low cost and, in accordance with some embodiments, low in its space requirements.

In accordance with the invention there is provided a personal training device for applying controlled load on body muscles, comprising:

- a ground supported frame that holds a torso support assembly and a foot support assembly;
- the torso support assembly comprising a torso support that is vertically displaceable with respect to the frame along a first axis and fixable at various positions along said first axis;
- the foot support assembly including a foot-engaging member that is horizontally displaceable with respect to the frame along a second axis normal to the first axis and fixable at various positions along said second axis;

whereby the controlled load is an adjustable body weight, the adjustment being achieved through the respective positioning of the torso support and the foot support along the first and the second axes.

The ground support frame may simply rest on the ground or may be firmly fixed thereto. The frame may also be designed to extend upwards and firmly engage the ceiling so as to obtain extra rigidity.

The vertical displacement and fixing of the torso support with respect to the frame and may be achieved through a variety of different means.

According to one embodiment, the frame comprises two vertical parallel bars which may be held together two or more cross bars, e.g. one at the top and one at the bottom of said vertical bars. The torso support, according to this embodiment, is typically slidably engaged with said vertical bars and fixable to the bars at various positions. Such engagement may be through the use of pins, through clamping means and generally through a variety of means known per se. As may be appreciated, the vertical positioning and fixing of the torso support may be achieved by a variety of means, for example through a hydraulic or pneumatic piston mechanism holding the torso support, and others.

The torso support assembly, according to one embodiment, comprises a horizontal bar. The bar typically spans the distance between the two vertical bars and occasionally also laterally from the two sides of said bars. The torso support assembly may also comprise a cushioning member to support the waste or back of the training individual. In accordance with an embodiment of the invention, the cushioning member is fitted over said lateral bar.

The vertical bar may be used for supporting the individual waste or back, but may also serve as a hand grip. In accordance with an embodiment of the invention, the device comprises separate handgrips that may be independently fixed to the frame although typically form part of the torso support assembly. In accordance with another embodiment, the torso support also includes arm supports.

The foot support member is typically displaceable along one or more ground bars and fixable at discreet positions to the one or more ground bars. In accordance with an embodiment of the invention the foot engaging member is angularly adjustable.

In accordance with some embodiments of the invention, the training device may be supplemented with a variety of conventional training aids such as a pull-up arrangement, a training bench, etc. The training device may therefore be used by one or more individuals to each perform a personalized training routine, which is tailor-designed to the individual's size, weight, age, physical ability and medical condition.

The training device is preferably structured such that the frames along the first axis and the second axis are dimensioned and joined to each other in a manner that a balance is maintained to provide for a sturdy structure adapted to endure various loads and exercise postures. Typically the foot support assembly extends along the second axis to an extent so as to provide support even against a momentum induced by substantially heavy training which might tilt the device about axis parallel to ground and normal to the first axis.

The present invention also provides a system for performing one or more exercises. Such a system comprises a device as disclosed herein; and at least one set of instructions for performing exercises using the device, by adjusting the body position or orientation of the user and in addition or in an alternative at least one element of the device. The at least one set of instructions may be in the form of printed instructions, in an electronic form such as computer on screen instructions, audio instructions, video instructions or a combination thereof, and may comprise sequences of positions, timings within each position and the like.

As part of the system there may be provided a data carrier, e.g. in the form of a magnetic or optical disc, that includes computer-readable instructions for displaying exercise instructions. In accordance with another embodiment, the system may comprise a dedicated site operable or a computer network, e.g. through the internet, and the instructions for carrying out an exercise may be delivered by accessing such a web-site.

BRIEF DESCRIPTION OF THE DRAWINGS

In order to understand the invention and to see how it may be carried out in practice, a preferred embodiment will now be described, by way of non-limiting example only, with reference to the accompanying drawings, in which.

DETAILED DESCRIPTION OF SPECIFIC EMBODIMENTS

As used herein, the phrase "personal training" may be understood as applying to training of any one or more individuals either in a private or public place.

As used herein, "device" and "apparatus" may be used interchangeably and refer to the invention as shown in the figures.

Figure 1:
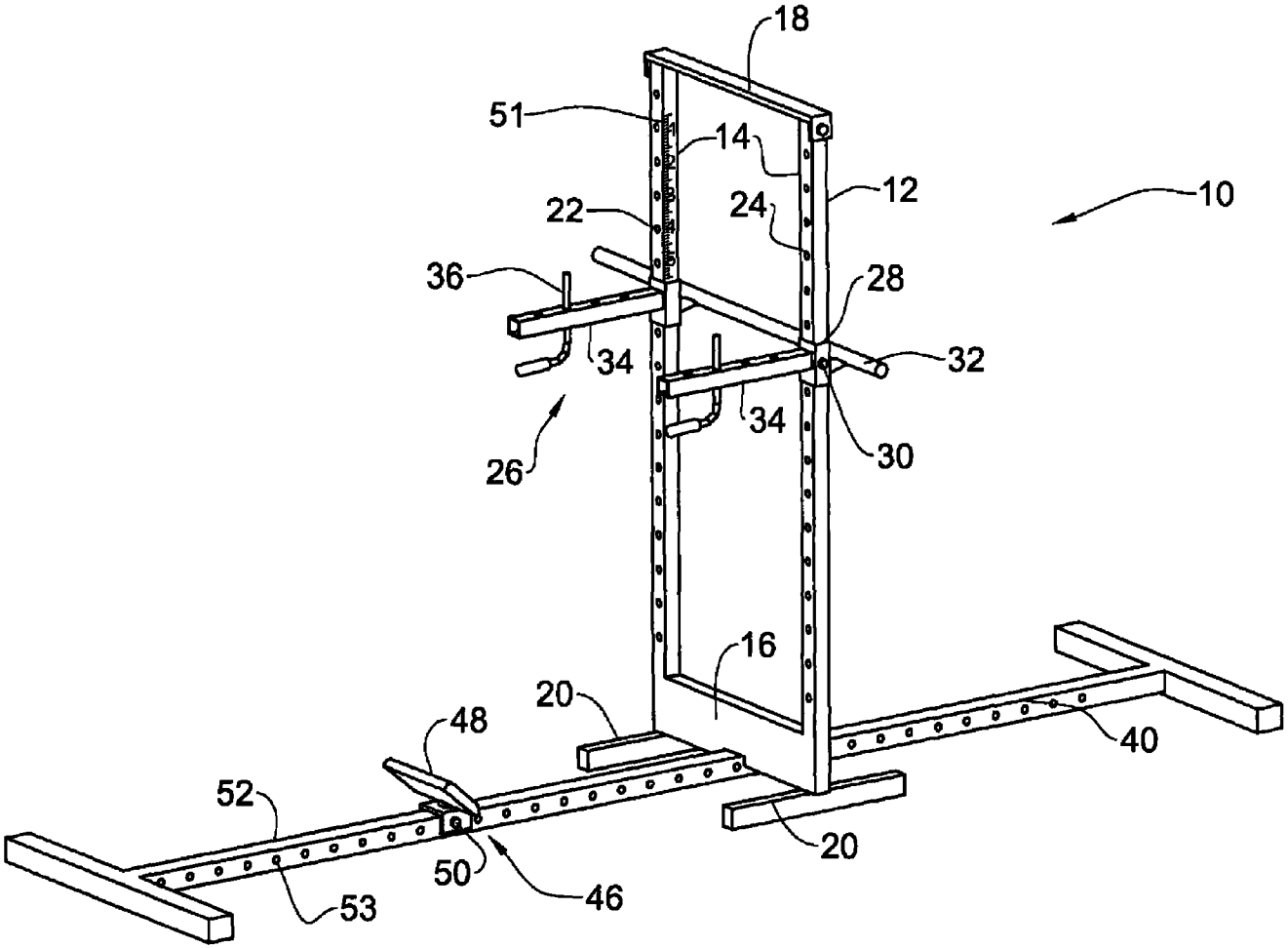
FIG. 1 shows a general view of a training device according to one embodiment of the invention.

Reference is first being made to FIG. 1 showing a training device generally designated 10, in accordance with an embodiment of the invention. The training device 10 is adapted to enable a user to exercise or isotonically train a wide variety of muscle groups by exerting muscular effort against varying degrees of the user's own body weight resistance to achieve various levels of physical activity or as part of a regular exercise regimen. The training device 10 is adapted to enable a user to exercise along a spectrum of body weight resistance levels ranging from relatively low levels of body weight resistance to relatively high levels of body weight resistance.

The training device 10 comprises a frame generally designated 12 with two vertical bars 14 forming a rectangular frame together with bottom cross bar 16 and top cross bar 18. The frame may in addition or in an alternative be provided with at least one crossbar which can be moved along and attached along the vertical bars 14 such as to maintain the bars 14 in parallel relation. The frame may comprise or be constructed from a variety of sturdy structural materials, e.g. materials having relatively lightweight properties, aluminum, hardened plastic, composite materials any other sturdy material or combination of materials. All or parts of the frame may be made of members designed to provide relatively lightweight but sturdy structure, such members may have a cross section of any geometrical shape such as L, T, I, U, □-shaped profile etc. The parts of the frame may be attached together via e.g. screws or pins, all or some of the frame parts may be welded together.

Fitted at the bottom and resting against the ground are ground supports 20.

The two vertical bars 14 define a first, vertical axis and have several substantially equi-distantly spaced parallel 22, 24, apertures forming a vertical scale thereupon (see FIG. 4A hereinbelow). Fitted onto the vertical bars is a torso support assembly, generally designated 26 which includes a pair of sliding mounts 28, vertically slidable along the bars and arrestable at discreet positions through a pin-type engagement 30. The pin-type engagement is arrestable at the apertures 22, 24. The torso support assembly further comprises a horizontal bar 32 that has a circular cross section of a length such that it spans laterally beyond vertical bars 14.

Figure 7:
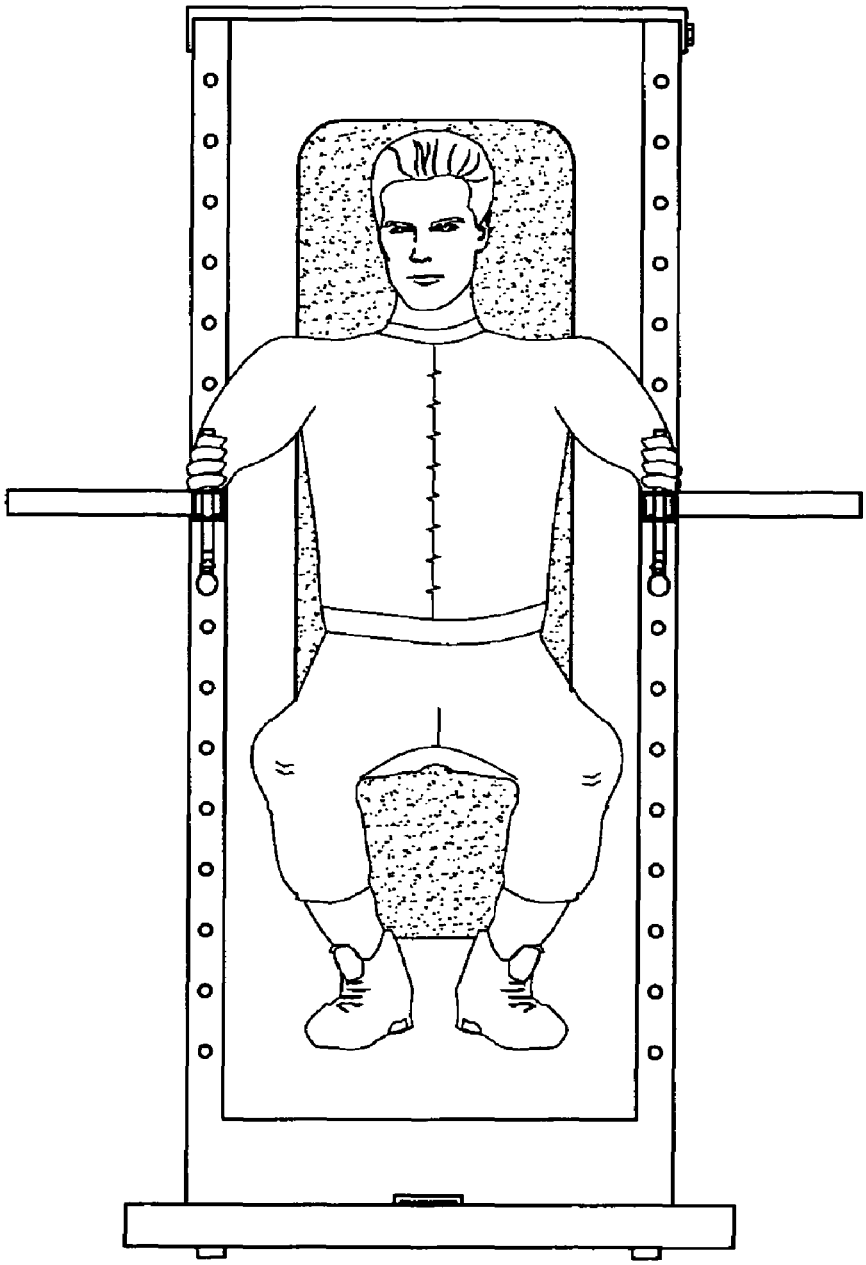
FIG. 7 shows the training device fitted with arm support accessories with an individual in a training position.

Linked to the torso support are horizontal projections 34 that may be fitted with a number of accessories, such as an L-shaped handgrips 36 or arm supports 38 that can be seen in FIG. 7.

The frame further includes a horizontal bar 40, which is supported against the ground, and which slidably engages a foot support generally designated 46 with a foot engaging member 48. The foot support is typically engaged with said horizontal bar and fixable to the bar at various positions. Such engagement may be through the use of one or more pins, through clamping means and generally through a variety of means known per se. As may be appreciated, the positioning and fixing of the foot support may be achieved by a variety of means, for example through a hydraulic or pneumatic piston mechanism holding the torso support, and other arrangements known to a person skilled in the art.

The vertical bars 14, the horizontal bar 40 and the ground supports 20 are dimensioned and joined together such that a balance is maintained throughout exercise routine between the vertical and the horizontal frame portions.

The leg support 46 may be arrested at various discreet positions along bar 40 through engagement by means of a pin 50. Pin 50 is engagable into one of the holes 52, 53, which are substantially equi-distantly spaced along bar 40 to form a horizontal axis. Alternatively, the pin 50 may be removed and the foot support 46 may be provided with a castor/caster engagement in contact with the bar 40 or the ground surface, so as to allow the user to easily move the foot support along the bar 40 as desired during specific training exercise.

The vertical and the horizontal scales may be provided with various indicia 51, such as degrees, numbers, letters, words etc., indicating various degrees of the user's own body resistance levels ranging from a relatively low to relatively high levels of resistance, thus providing a spectrum of at least body weight resistance levels and the level of the users fitness and enabling the user to select the desired level of resistance from the spectrum.

As can be seen from FIGS. 1 and 7, this arrangement is suitable for simple adaptation for use by different individuals with correspondingly different physical abilities, some of whom may be overweight, have some physical limitation or handicap. Thus, this device is suited for being used at home as well as for use in public gyms, sports clubs and country clubs.

Figure 2:
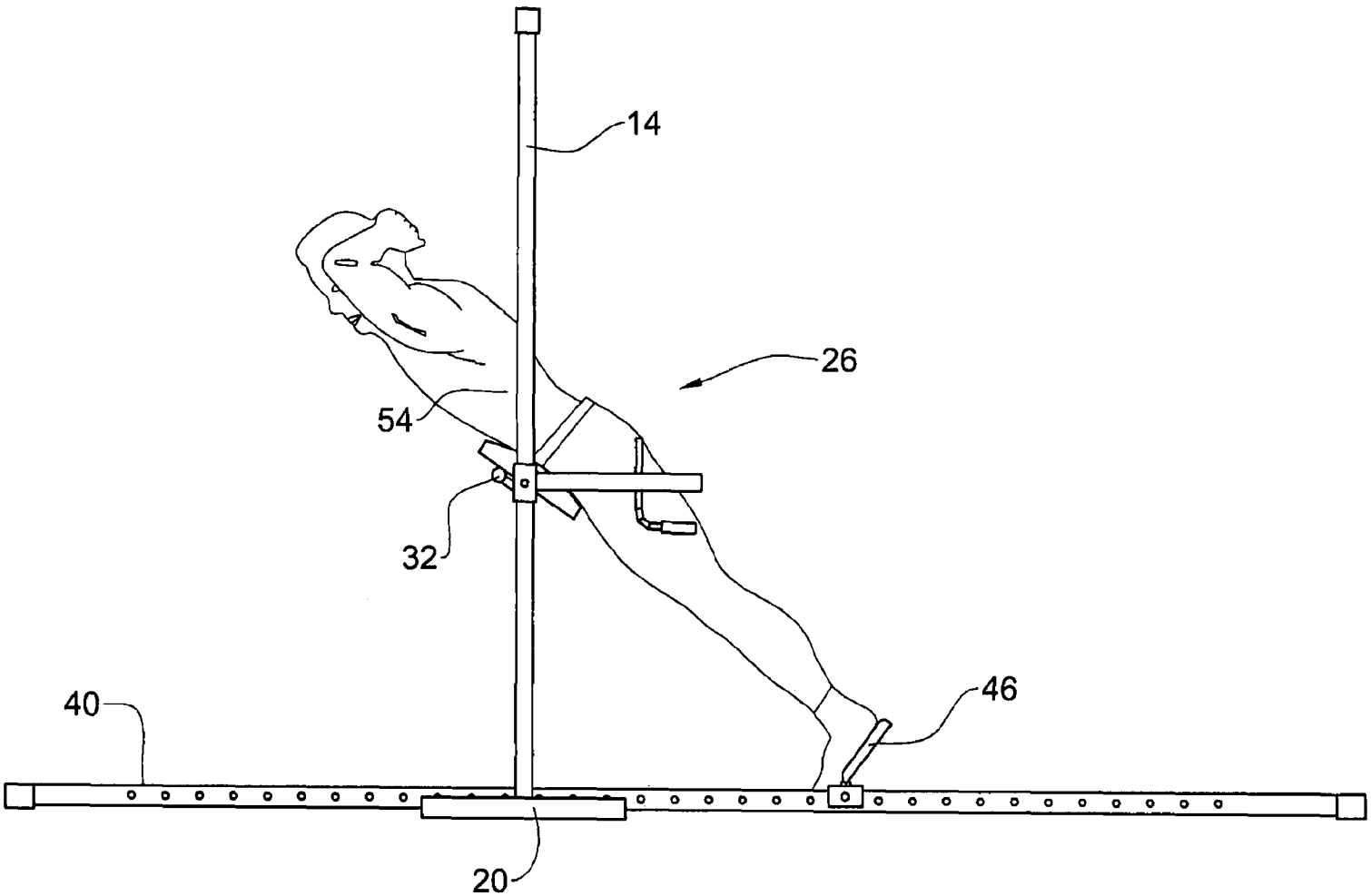
FIG. 2 shows the training device with an individual in one training configuration.

Turning now to FIG. 2, device 10 can be seen in one training position. In this training position, fitted onto bar 32 is a cushioning member 54. The legs of the individual rest against the foot support while its waist rests against the cushioning member 54. Through respective horizontal displacement of foot rest 46 and torso support 32, the same type of training can be carried out with essentially different muscle load, achieved by the different angles that are obtained as a result of such respective positioning. Such positioning also allows adjusting the device according to the body size of different training individuals. The device can therefore be used by individuals of significantly different body weight.

Figure 3:
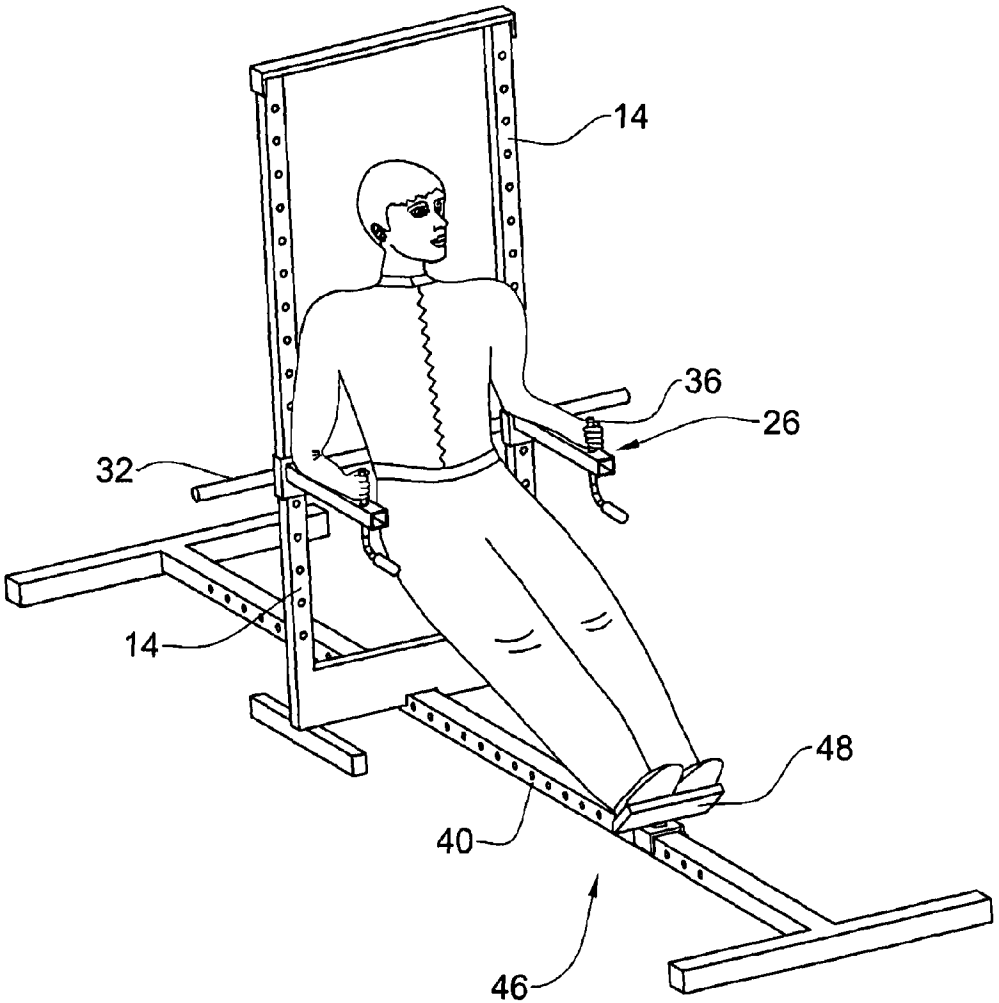
FIG. 3 shows the training device with an individual in a second training configuration.

Another training position can be seen in FIG. 3 where the legs rest against the foot support 46 while the training individual grips handgrips 36 (which are oppositely engaged as in the manner seen in FIG. 7). Through respective adjustments of the position of leg support 46 along bar 40 and torso support 26 along bars 14, different body angles and hence different load on the trained armed and/or chest muscles can be achieved.

Figure 4A:
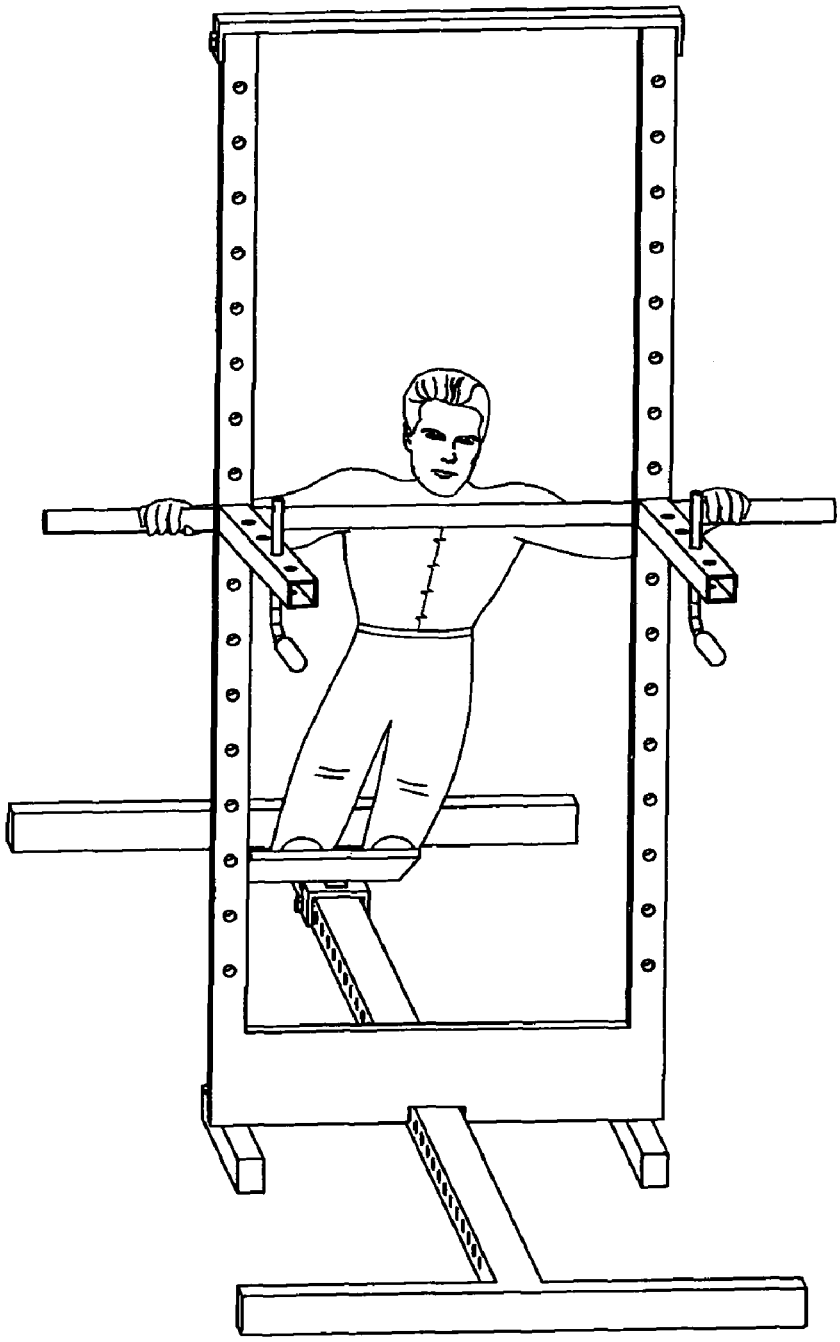
FIGS. 4A and 4B show the training device with an individual in another training configuration, in two consecutive training postures.
Figure 4B:
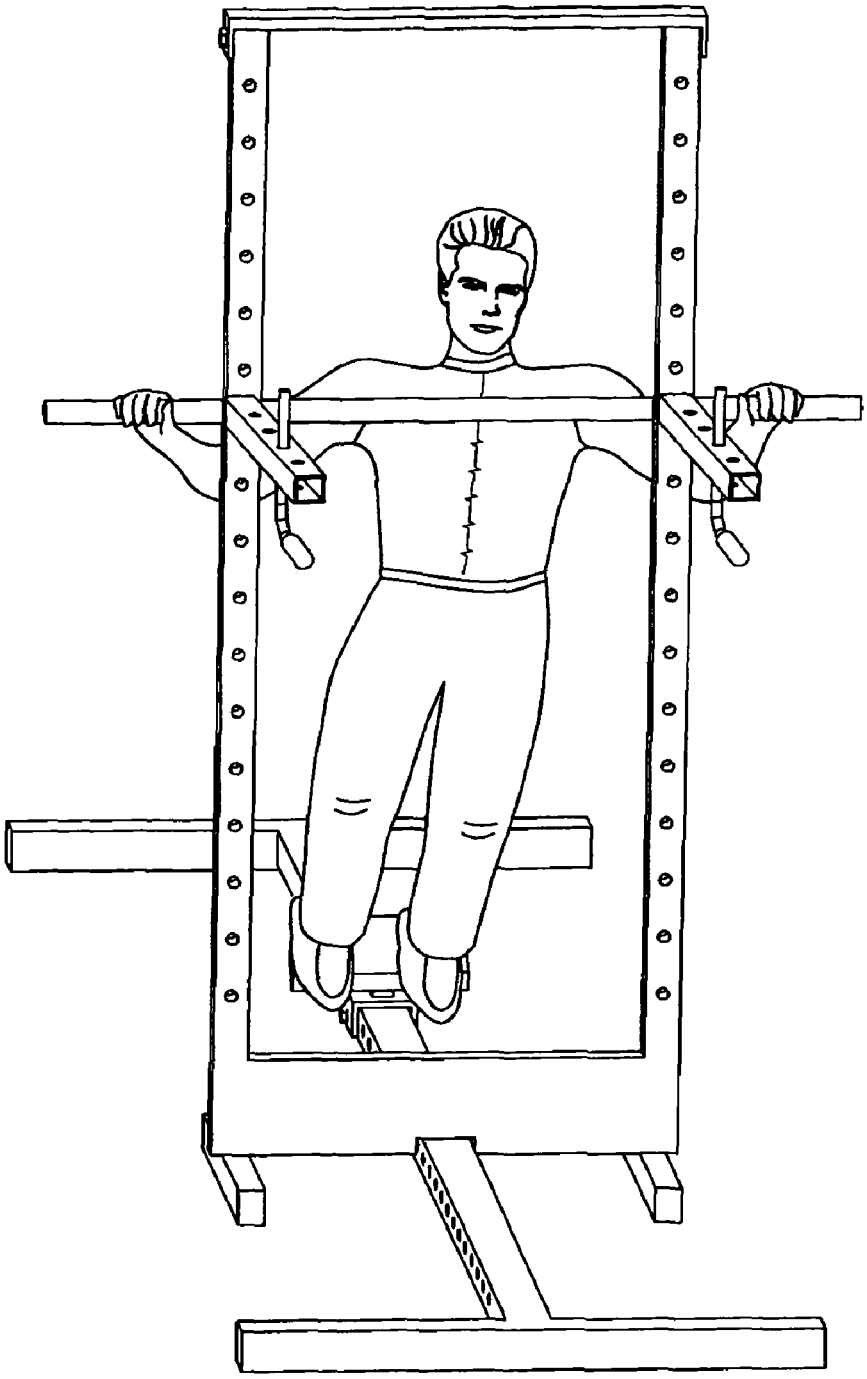

FIGS. 4A and 4B show another training position that makes use of crossbar 32 and leg support assembly 46. Here again, the individual, seen in two training positions in FIGS. 4A and 4B, will train against different partial body weight caused loads, in dependence of the respective positioning of leg support 46 and torso support 32, and hence the overall body angle.

Figure 5:
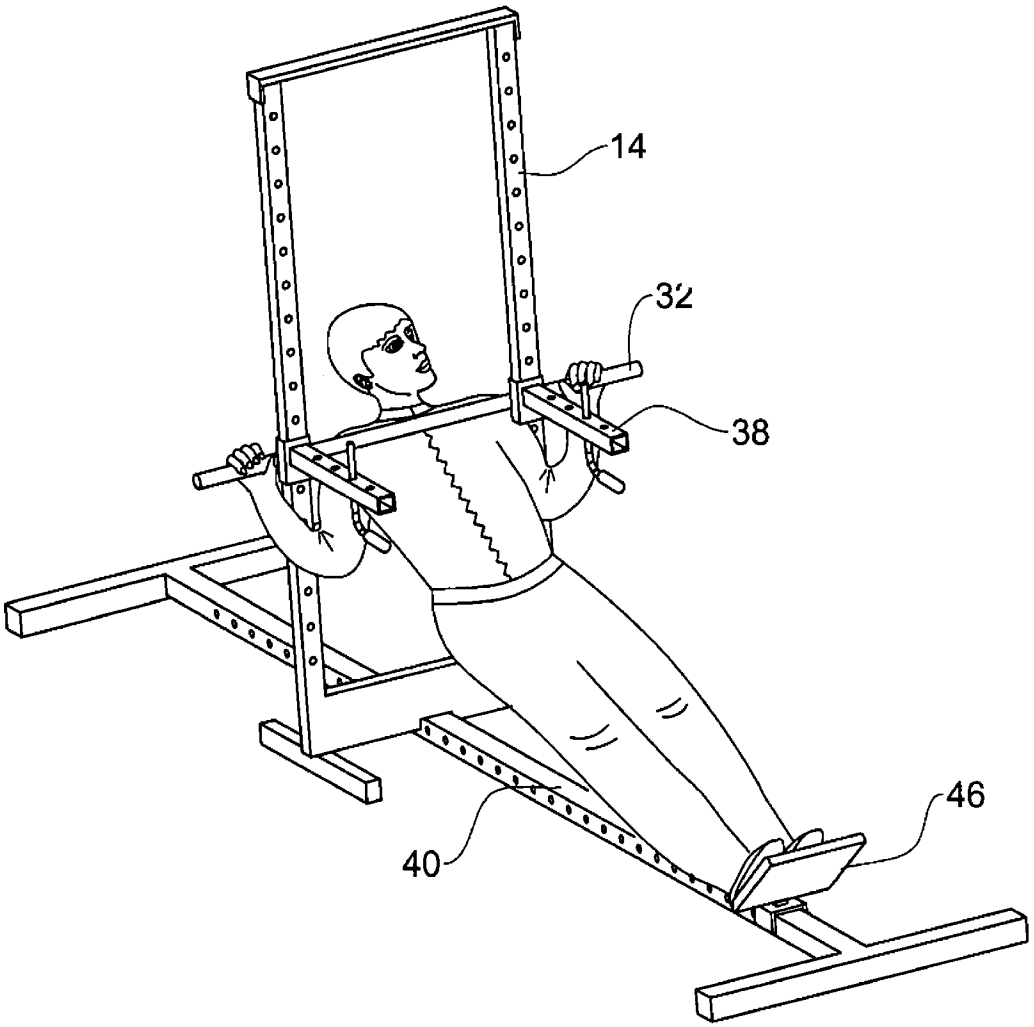
FIG. 5 shows the training device, with an individual in a further training configuration.

FIG. 5 shows the device at the same configuration of FIGS. 4A and 4B used differently. According to yet an example of the invention, a training bench 62 (shown in FIG. 6) may be vertically fixed to the bar 40 to take the place of the leg support 46, such that user's legs will be elevated and rest on leg supports 63 fitted at a rear of the training bench and thus increase the load of the individual against which the individual will train. Leg supports 63 may be fitted at various locations along/across the bench such as to provide support to the legs at various elevation levels whilst the bench is substantially vertically oriented.

Figure 6:
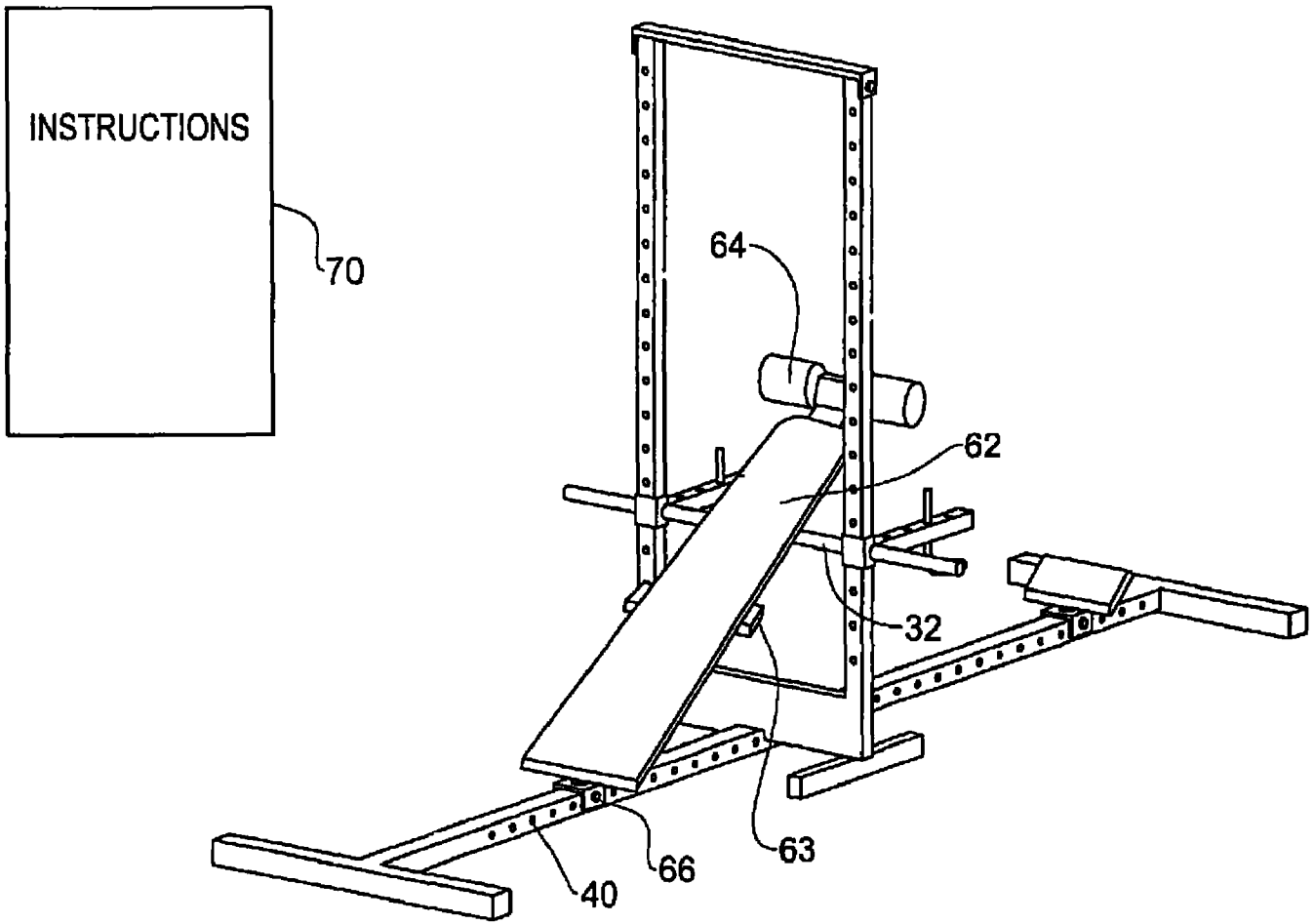
FIG. 6 shows the training device fitted with a conventional training bench.

FIG. 6 shows the device 10 fitted with an inclined universal training bench 62, integrated with ankle grips 64. Bench 62 is fixed to bar 40 through engaging assembly 66 and resting over bar 32.

The training device may therefore be used by one or more individuals to each perform a personalized training routine, which is tailor-designed to the individual's size, weight, age, physical ability and medical condition.

The device may be folded up compactly and conveniently stored, taking up minimal floor space.

In accordance with an example of the invention, the training device of the invention may be provided with a set of exercise instructions 70, as shown in FIG. 6. The instructions 70 may be provided in one or more of printed format; in an electronic format, e.g. in the form of an accessible Internet site or a data carrier carrying a set of computer executable instructions; in the form of video or in an audio format.

Those skilled in the art to which this invention pertains will readily appreciate that numerous changes, variations and modifications can be made without departing from the scope of the invention mutatis mutandis.

The invention claimed is:

1. A personal training device for applying a controlled load on body muscles, the personal training device comprising:

a ground supported frame, having a front side and a back side, the ground supported frame comprising:

at least one horizontal bar, extending along a horizontal axis and being supported against the ground; and at least one vertical bar extending along a vertical axis, the at least one vertical bar being displaceable with respect to the at least one horizontal bar;

a torso support assembly, supported by the at least one vertical bar, and being vertically displaceable on the at least one vertical bar, and fixable at various positions along the at least one vertical bar; and a foot support assembly including a foot-engaging member horizontally displaceable along one or more ground bars and fixable at discrete positions to the one or more ground bars, the foot engaging member being displaceable along the one or more ground bars into positions on both sides of the ground supported frame.

2. A device according to claim 1, wherein the controlled load is at least a user's body weight adjusted by positioning of the torso support assembly and the foot support assembly, respectively, along the vertical axis and the horizontal axis.

3. A device according to claim 1, wherein the ground supported frame comprises two vertical parallel bars and the torso support assembly is slidably engaged with said vertical parallel bars and fixable to the vertical parallel bars at various positions.

4. A device according to claim 3, wherein the torso support assembly is fixable to the vertical parallel bars by pins.

5. A device according to claim 1, wherein the torso support assembly comprises a horizontal bar.

6. A device according to claim 1, wherein the torso support assembly comprises a cushioning member to support the waist or back of a user.

7. A device according to claim 1, further comprising a handgrip or an arm support.

8. A device according to claim 4, wherein the ground supported frame comprises a vertically arranged series of substantially equidistantly-placed pairs of horizontally parallel holes.

9. A device according to claim 8, wherein the pins are configured to respectively engage the horizontally parallel holes.

10. A device according to claim 4, wherein said ground supported frame comprises a horizontally arranged series of substantially equidistantly-placed pairs of horizontally parallel holes.

11. A device according to claim 10, wherein the pins are configured respectively engage the horizontally parallel holes.

12. A device according to claim 1, wherein the at least one vertical bar along the vertical axis and the at least one horizontal bar along the horizontal axis are provided with indicia.

13. A personal training system for applying the controlled load on body muscles of a user, comprising:

the device according to claim 1; and at least one set of instructions for performing exercises using the device, by adjusting at least a position orientation of a user's body.

14. A system according to claim 13, wherein the at least one set of instructions further provides for adjustment of at least one element of the device.

15. A system according to claim 13, wherein the at least one set of instructions is in a form selected from a printed instruction, an electronic instruction, an audio instruction, a video instruction or combinations thereof.

* * * * *